US005328324A

United States Patent [19]

Dodd

[11] Patent Number: 5,328,324

[45] Date of Patent: Jul. 12, 1994

[54] AEROFOIL BLADE CONTAINMENT

[75] Inventor: Alec G. Dodd, Ambergate, England

[73] Assignee: Rolls-Royce plc, London, United Kingdom

[21] Appl. No.: 963,756

[22] Filed: Oct. 20, 1992

[51] Int. Cl.[5] ..... F04D 29/40

[52] U.S. Cl. ..... 415/9

[58] Field of Search ..... 415/9

[56] References Cited

U.S. PATENT DOCUMENTS

| | | | |
|---|---|---|---|
| 1,698,514 | 1/1929 | Schmidt | 415/9 |
| 3,602,602 | 8/1971 | Motta | 415/9 |
| 3,974,313 | 8/1976 | James | 415/9 |
| 4,648,795 | 3/1987 | Lardellier . | |
| 4,902,201 | 2/1990 | Neubert | 415/9 |
| 4,934,899 | 6/1990 | Patacca | 415/9 |
| 4,961,685 | 10/1990 | Neubert | 415/9 |

FOREIGN PATENT DOCUMENTS

| | | |
|---|---|---|
| 868197 | 5/1961 | United Kingdom . |
| 2093125 | 8/1982 | United Kingdom . |
| 2159886 | 12/1985 | United Kingdom . |
| 2219633 | 12/1987 | United Kingdom . |

*Primary Examiner*—John T. Kwon
*Attorney, Agent, or Firm*—Oliff & Berridge

[57] ABSTRACT

An aerofoil blade containment structure that is adapted to surround the low pressure turbine casing of a gas turbine engine includes an annular support member upon which is mounted a glass fiber knitted sleeve. The knitted sleeve is folded to define a plurality of interconnected secondary sleeves that are arranged in coaxial superposed relationship. Use of the containment structure obviates the use of thick, and therefore undesirably heavy, turbine casings.

6 Claims, 1 Drawing Sheet

AEROFOIL BLADE CONTAINMENT

BACKGROUND OF THE INVENTION

This invention relates to the containment of aerofoil blades and in particular to the containment of gas turbine engine rotor aerofoil blades.

Gas turbine engines typically include large numbers of aerofoil blades that are mounted for rotation within the engine. Normally such aerofoil blades are extremely reliable and present no problems during normal engine operation. However in the unlikely event of one of the blades becoming detached from its mounting, measures must be taken to ensure that the detached blade causes as little damage as possible to the structures surrounding the engine.

One way of limiting such damage is to manufacture the casing that normally surrounds the blades so that it is sufficiently robust to contain a detached blade. Unfortunately this results in a casing that is very thick, and therefore undesirably heavy.

SUMMARY OF THE INVENTION

It is an object of the present invention to provide a lightweight aerofoil blade containment structure.

According to the present invention, an aerofoil blade containment structure includes a continuous woven sleeve for positioning externally of a gas turbine engine casing enclosing rotor aerofoil blades, the woven sleeve is folded to define a plurality of interconnected secondary sleeves arranged in coaxial superposed relationship with each other. The sleeve is woven from fibres that are capable both of withstanding the operational temperatures externally of such a gas turbine engine casing without suffering significant thermal degradation and of containing any failed rotor aerofoil blades released from within the casing radially inwardly of the sleeve.

BRIEF DESCRIPTION OF THE DRAWINGS

The present invention will now be described, by way of example, with reference to the accompanying drawings in which.

DETAILED DESCRIPTION OF PREFERRED EMBODIMENTS

Figure 1:
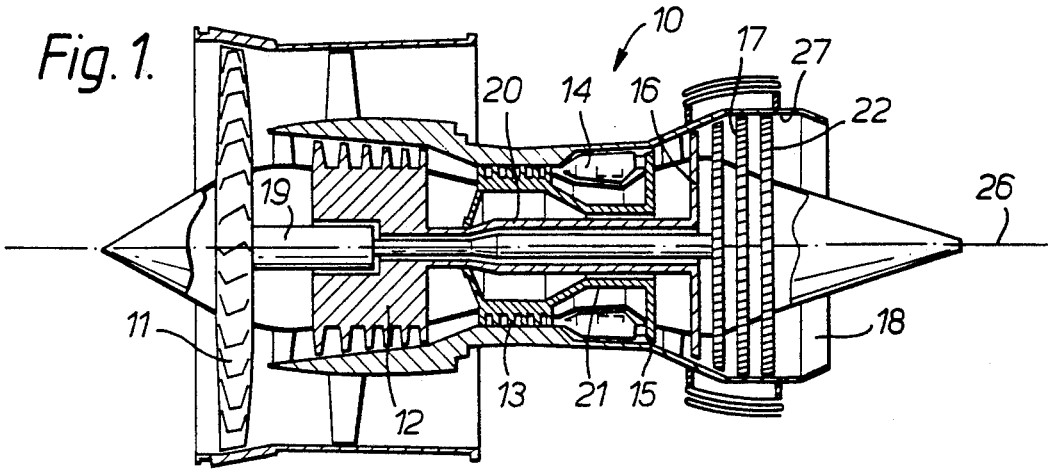
FIG. 1 is a sectioned side view of a ducted fan gas turbine engine having an aerofoil blade containment structure in accordance with the present invention.

Referring to FIG. 1, a ducted fan gas turbine engine generally indicated at 10 is of conventional construction and operation. Briefly it comprises, in axial flow series, a-ducted fan 11, an intermediate pressure compressor 12, a high pressure compressor 13, combustion equipment 14, high, intermediate and low pressure turbines 15,16 and 17 respectively and an exhaust nozzle 18. The fan 11 is driven by the low pressure turbine 17 via a first shaft 19. The intermediate pressure compressor 12 is driven by the intermediate pressure turbine 16 via a second shaft 20. Finally the high pressure compressor 13 is driven by the high pressure turbine 15 via a third shaft 21. The first, second and third shafts 19,20 and 21 are concentric.

During the operation of the engine 10, air initially compressed by the fan 11 is divided into two flows. The first and major flow is exhausted directly from the engine 10 to provide propulsive thrust. The second flow is directed into the intermediate pressure compressor 12 and high pressure compressor 13 where further compression takes place. The compressed air is then directed into the combustion equipment 14 where it is mixed with fuel and combustion takes place. The resultant combustion products then expand through, and thereby drive, the high, intermediate and low pressure turbines 15,16 and 17, before being exhausted through the nozzle 18 to provide additional propulsive thrust.

The low pressure turbine 17 comprises three axially spaced apart annular arrays of rotor aerofoil blades 22. The aerofoil blades 25 are mounted for rotation about the longitudinal 26 axis of the engine 10 on discs (not shown) in the conventional manner. The rotor aerofoil blades 22 are enclosed by the low pressure turbine casing 27.

Figure 2:
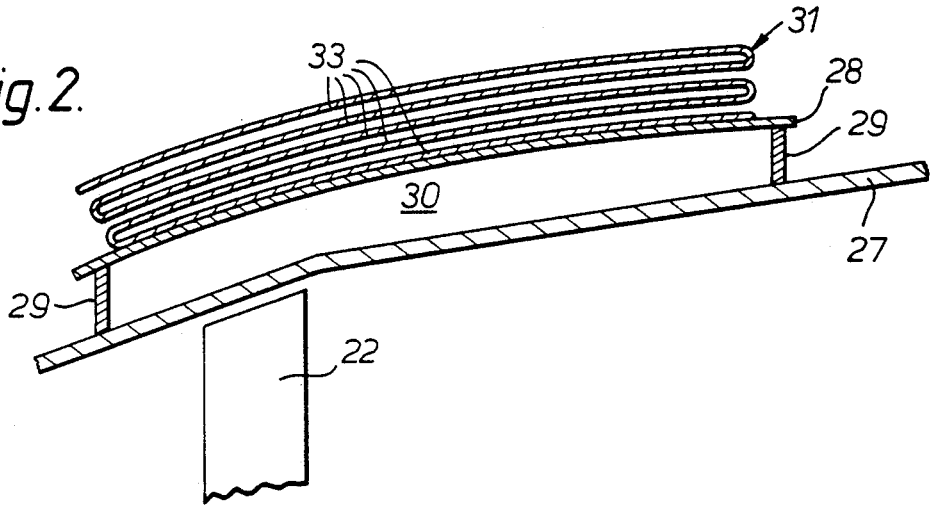
FIG. 2 is a view on an enlarged scale of a portion of the aerofoil blade containment structure of the ducted fan gas turbine engine shown in FIG. 1.
Figure 3:
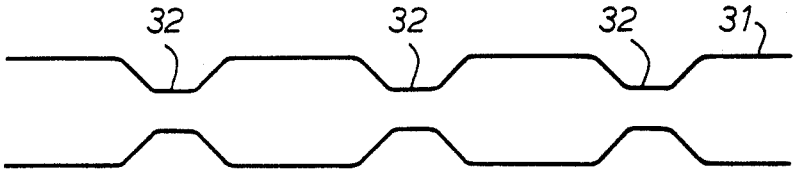
FIG. 3 is a view of a part of the aerofoil blade containment structure of the ducted fan gas turbine engine shown in FIG. 1 prior to its mounting on that gas turbine engine.

The low pressure turbine casing 27 is in turn partially enclosed by a lightweight annular support member 28 (which can be seen more easily if reference is now made to FIG. 2). The support member 28 is radially spaced apart from the turbine casing 27 by a plurality of radially extending feet 29. This results in the definition of an annular passage 30 between the casing 27 and support member 28. During operation of the gas turbine engine 10, some of the air exhausted from the fan 11 is directed to flow through the passage 30. This ensures adequate cooling of both the casing 27 and the support member 28.

The support member 28 carries a lightweight containment sleeve 31 that is knitted from glass fiber. Glass fiber is used in this particular application because of its ability to withstand the high temperatures that it is likely to encounter in this area of the turbine casing 27 without suffering significant thermal degradation. However other suitable high temperature resistant materials could usefully be employed if so desired. Moreover in certain circumstances it may be desirable to mount the containment sleeve 31 directly on the casing 27 without the use of the support member 28.

The containment sleeve 31 is initially knitted in the form of an elongate sleeve narrowed at regular intervals 32. Such narrowing 32 of the sleeve 31 is not essential but it assists in the folding of the sleeve 31 to the final configuration shown in FIG. 2. In that final configuration, the sleeve 31 defines a plurality of interconnected secondary sleeves 33 that are arranged in coaxial superposed relationship with each other.

Although in this particular case, the sleeve 31 is knitted, it will be appreciated that other suitable forms of weave could be employed if so desired.

The sleeve 31 is woven to such dimensions that when folded in the manner described above to define the secondary sleeves 33, it can be deformed so as to be a snug fit on the support member 28.

As can be seen from FIG. 2, the support member 28 is generally of frusto-conical configuration so as to approximately correspond in configuration with the turbine casing 27. However the knitted weave of the sleeve 31 enables the sleeve 31 to deform to such an extent that the previously mentioned snug fit on the support member 28 is achieved.

In the event of one of the turbine blades 22 becoming detached from its supporting disc during the operation of the engine 10, it will pass through the turbine casing 27. This is because the casing 27 is made only sufficiently thick for it to carry out its normal functions. However as soon as the detached turbine blade 22 reaches the support member 28 and glass fiber sleeve 31, it passes through the support 28 but is constrained by the sleeve 31. Thus the multiple layers defined by the secondary sleeves 33 are sufficiently strong to capture and retain the detached blade 22.

Since the multiple layers defined by the secondary sleeves 33 are composed of substantially continuous glass fibers, the capture of a detached turbine blade is more effective than would be the case if discontinuous fibers were used. Such discontinuous fibers would be present if, for instance, the secondary sleeves 33 were discrete and discontinuous.

If the glass fiber sleeve 31 were not to be utilized, the turbine casing 27 would have to be sufficiently thick to ensure containment of detached turbine blades 22. This typically would mean that the casing 27 would have to be some 35% heavier than when used in conjunction with the sleeve 31.

The present invention is not specifically restricted to the containment of turbine aerofoil blades 22. It will be appreciated that it could be applied in other areas of the engine 10 where aerofoil blade containment could be a problem. If those other areas are in cooler parts of the engine 10 then fibers which are sufficiently strong but that do not have high temperature resistance could be employed. For instance a sleeve of knitted Kevlar (registered trade mark) fibers could be provided around one of the compressor regions of the engine 10.

I claim:

1. An aerofoil blade containment structure comprising a continuous woven sleeve disposed circumferentially about a gas turbine engine casing enclosing rotor aerofoil blades, said woven sleeve being formed of a plurality of interconnected sleeves connected in end-to-end relationship, wherein said woven sleeve is folded to define a plurality of interconnected secondary sleeves arranged in concentric superposed relationship with each other, said sleeve being woven from fibers that are capable both of withstanding the operational temperatures externally of such a gas turbine engine casing without suffering significant thermal degradation and of containing any failed rotor aerofoil released from within said casing radially inwardly of said sleeve.

2. An aerofoil blade containment structure as claimed in claim 1 wherein said woven sleeve is mounted on a support member maintained in coaxial, radially spaced apart relationship with said casing.

3. An aerofoil blade containment structure as claimed in claim 1 wherein said fibers are knitted.

4. An aerofoil blade containment structure as claimed in claim 1 wherein said containment structure is adapted to be mounted around a low pressure turbine casing of a gas turbine engine.

5. An aerofoil blade containment structure as claimed in claim 1 wherein said woven sleeve is initially woven, prior to folding as an elongate sleeve, with portions at regular axially spaced apart locations which are of smaller diameter than the remainder thereof.

6. An aerofoil blade containment structure as claimed in claim 1 wherein said fibers are glass fibers.

* * * * *